US006240810B1

(12) United States Patent
Ho

(10) Patent No.: US 6,240,810 B1
(45) Date of Patent: Jun. 5, 2001

(54) RATCHET SCREWDRIVER HAVING A CONCEALABLE RATCHET SHIFTER

(75) Inventor: Shih-Chi Ho, Taichung Hsien (TW)

(73) Assignee: Yeh-Hsing Enterprise Co., Ltd., Taichung Hsien (TW)

( * ) Notice: Subject to any disclaimer, the term of this patent is extended or adjusted under 35 U.S.C. 154(b) by 0 days.

(21) Appl. No.: 09/624,411

(22) Filed: Jul. 24, 2000

(30) Foreign Application Priority Data

Aug. 12, 1999 (TW) ..... 088213656

(51) Int. Cl.[7] ..... B25B 13/46
(52) U.S. Cl. ..... 81/62; 192/43.1; 81/63.1
(58) Field of Search ..... 81/60–63.2; 192/43, 192/43.1

(56) References Cited

U.S. PATENT DOCUMENTS 5,379,873 * 1/1995 Shiao ..... 192/43
5,910,196 * 6/1999 Huang ..... 81/60
6,151,995 * 11/2000 Shu ..... 81/63.1

* cited by examiner

*Primary Examiner*—D. S. Meislin
(74) *Attorney, Agent, or Firm*—Harrison & Egbert

(57) ABSTRACT

A ratchet screwdriver including a ratchet shifter having a dial seat which is concealed by a housing. The dial seat is provided with a bar body and a position confining hole for disposing a tension member. The dial seat is provided at the front end with an urging portion which is juts out of the main body. The main body is provided with a circular rotation member which is provided with a rotating slot corresponding in location to the urging portion of the dial seat. The circular rotation member is provided with a neck portion having an insertion protrusion for pivoting with the main body. The main body is provided in an insertion circular edge with a notch for locating the insertion protrusion.

3 Claims, 10 Drawing Sheets

RATCHET SCREWDRIVER HAVING A CONCEALABLE RATCHET SHIFTER

BACKGROUND OF THE INVENTION

1. Field of the Invention

The present invention relates generally to a ratchet screwdriver, and more particularly to a ratchet screwdriver having a concealable ratchet shifter.

2. Description of Related Art

As shown in FIGS. 1 and 2, a ratchet screwdriver 10 of the prior art comprises a handle 11 having a main body 12 which is provided at the front end with a central axial hole 14 with a heart hole 13 for pivoting a shaft rod 17. The shaft rod 17 has a gear 15 and a pillar 16. The main body 12 is provided with an insertion slot 18 for receiving a stop plate 19. The gear 15 is actuated by two reverse plates 20 disposed on the top of the main body 12. The two reverse plates 20 are provided with a dial seat 22 having two resilient press plates 21. A casing 24 has a position confining hole 23 and is fitted into the front end of the main body 12 such that the cut edge 25 of the casing 24 is stopped on a projection 26 of the main body 12. The main body 12 is provided at the front end with a locking member 28 having a carrying hole 27.

Such a prior art ratchet screwdriver as described above is defective in design because the protruded knob 29 of the dial seat 22 makes the assembly of the casing 24 difficult, and because dial seat 22 can not be easily adjusted.

BRIEF SUMMARY OF THE INVENTION

The primary objective of the present invention is to provide a ratchet screwdriver with a concealable ratchet shifter.

The features, functions, and advantages of the present invention will be readily understood upon a thoughtful deliberation of the following detailed description of the preferred embodiments of the present invention with reference to the accompanying drawings.

DETAILED DESCRIPTION OF THE INVENTION

Figure 1:
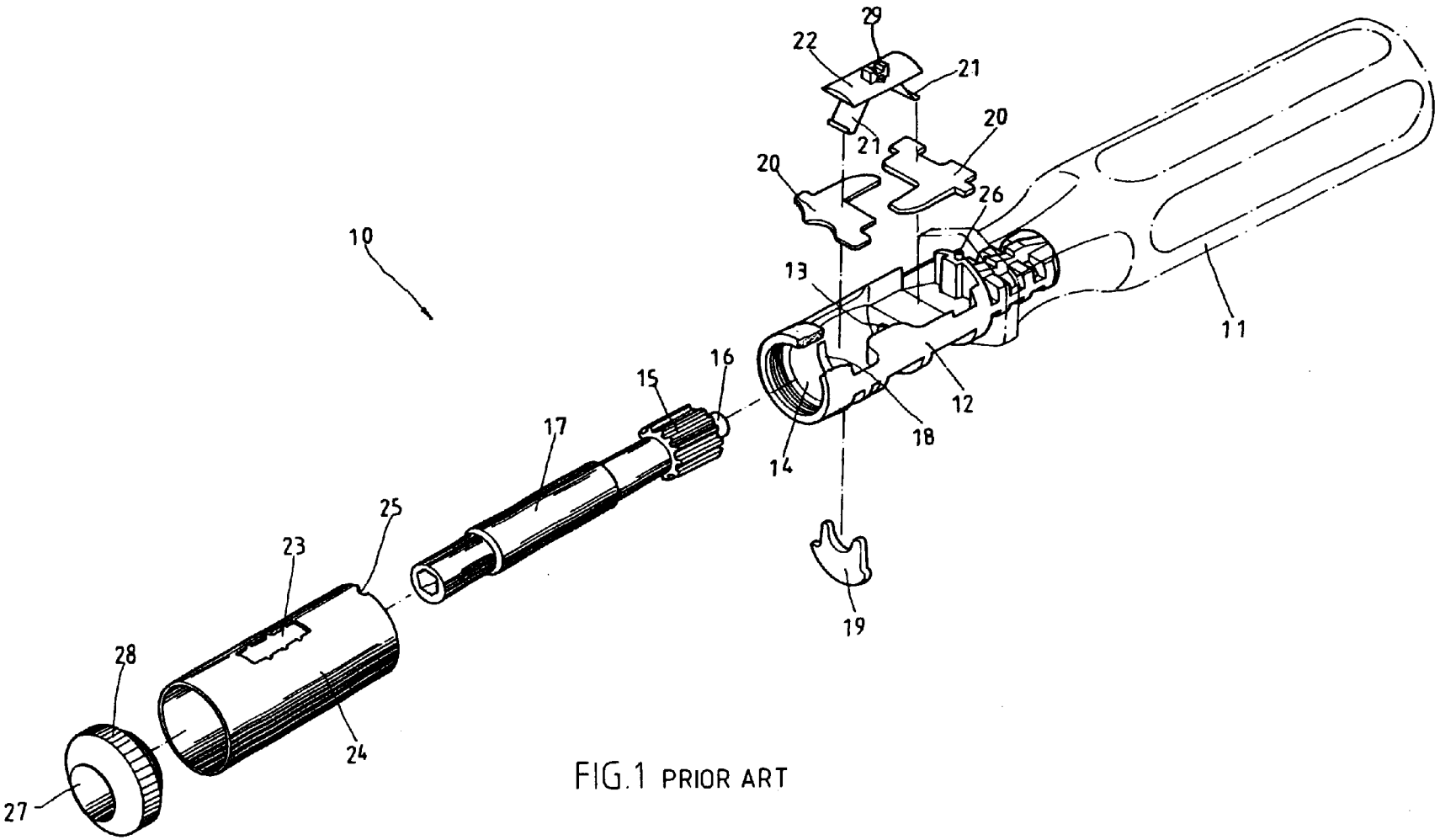
FIG. 1 PRIOR ART
FIG. 1 shows an exploded view of a ratchet screwdriver of the prior art.
Figure 2:
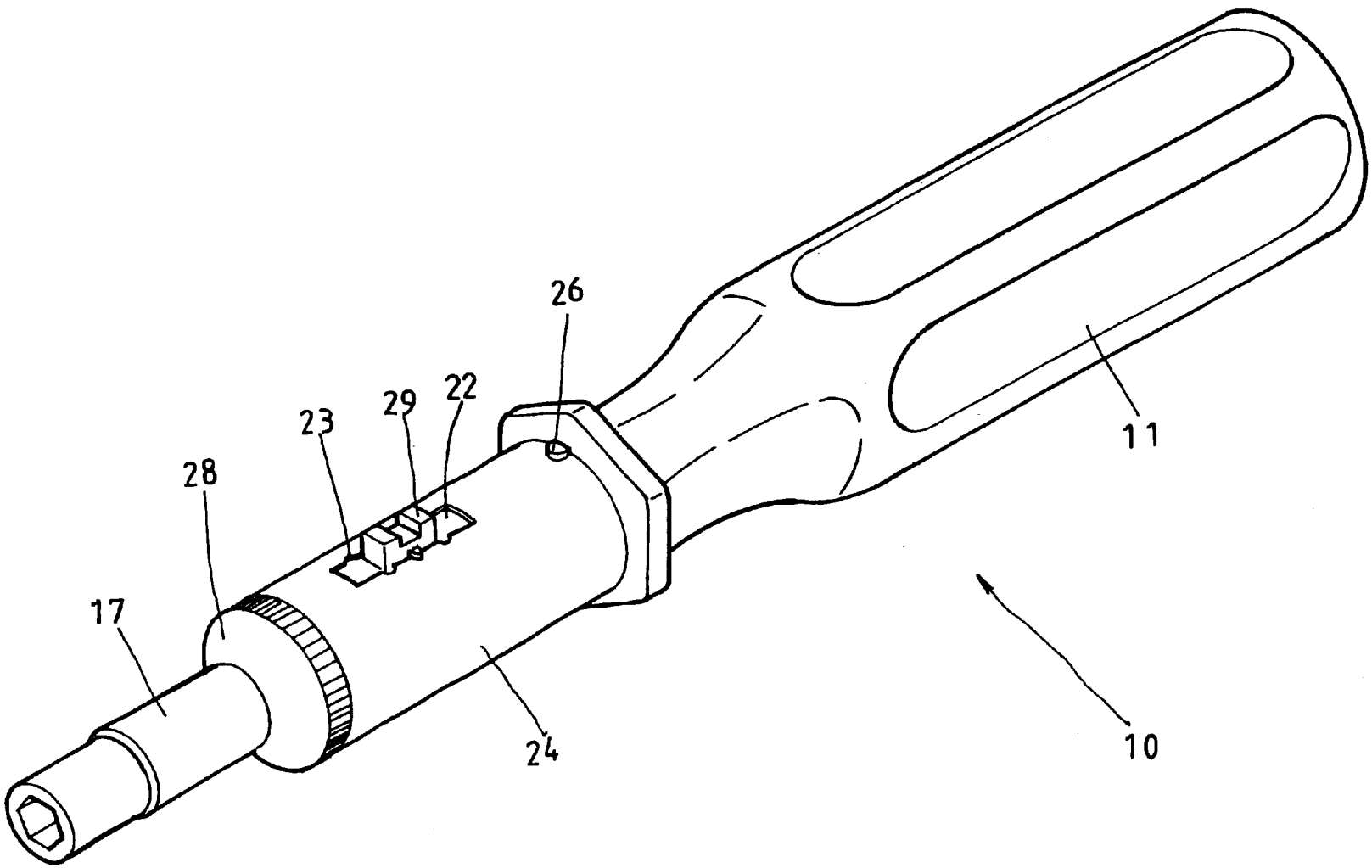
FIG. 2 PRIOR ART
FIG. 2 shows a perspective view of the ratchet screwdriver of the prior art.
Figure 3:
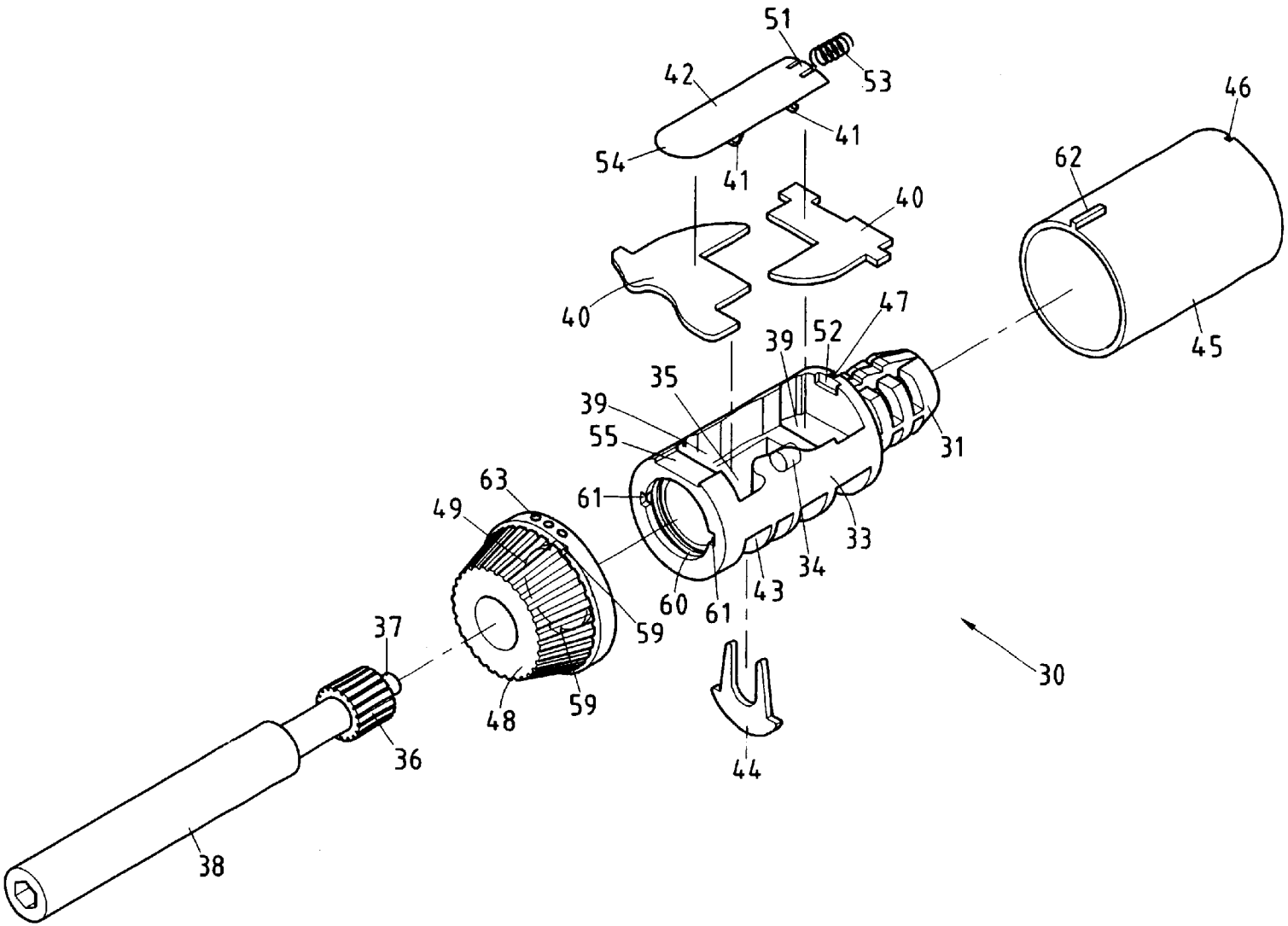
FIG. 3 shows an exploded view of a ratchet screwdriver of the present invention.
Figure 4:
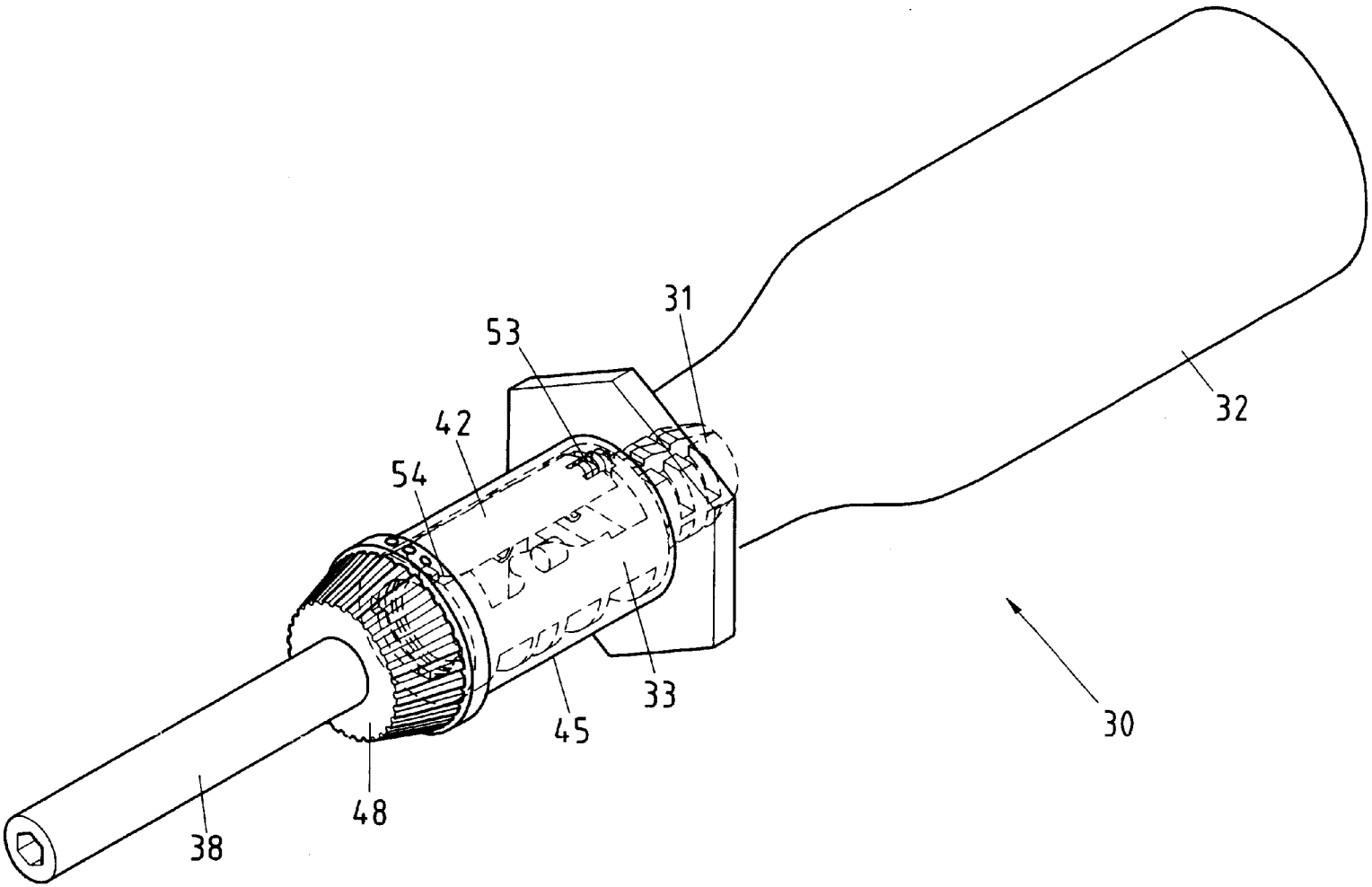
FIG. 4 shows a prospective view of the ratchet screwdriver of the present invention.
Figure 5:
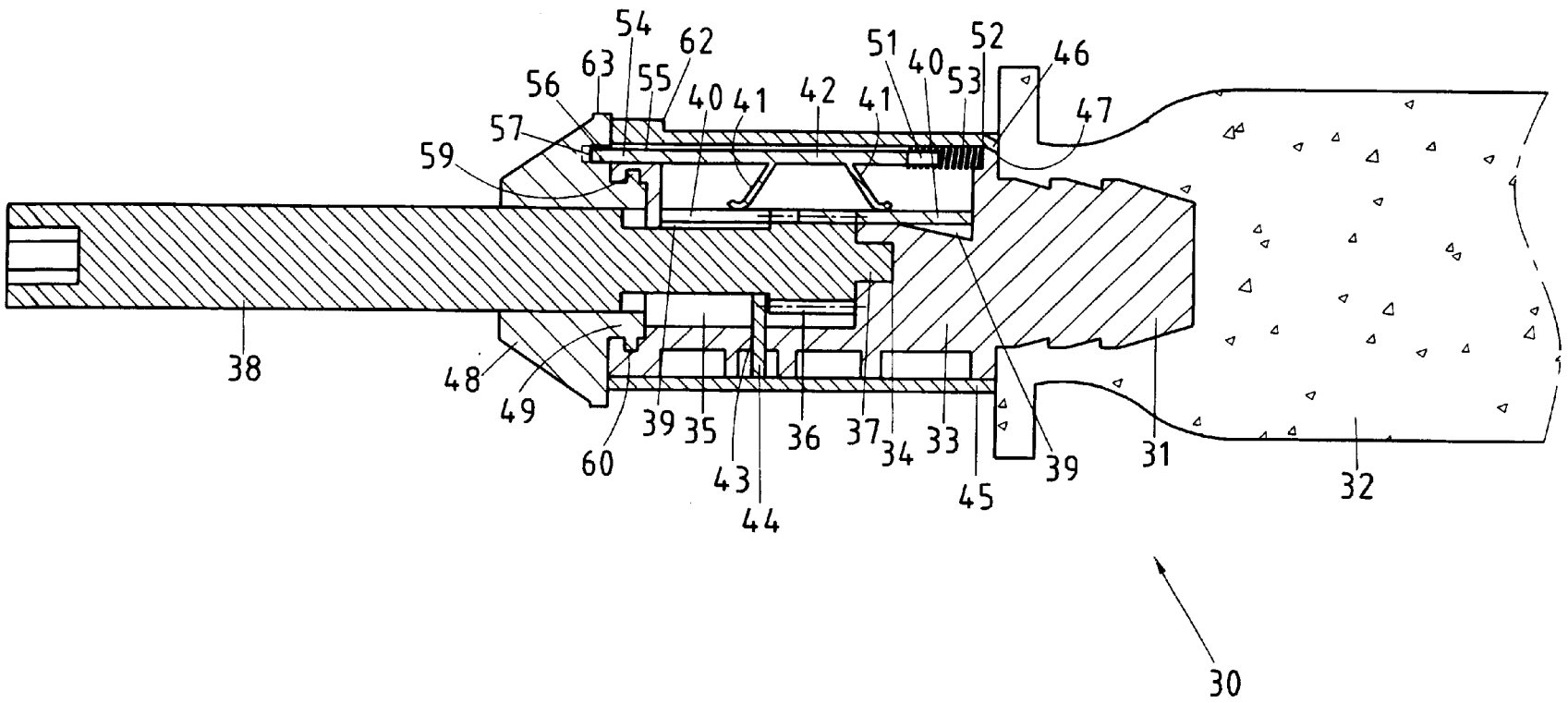
FIG. 5 shows a sectional view of the ratchet screwdriver of the present invention.
Figure 6:
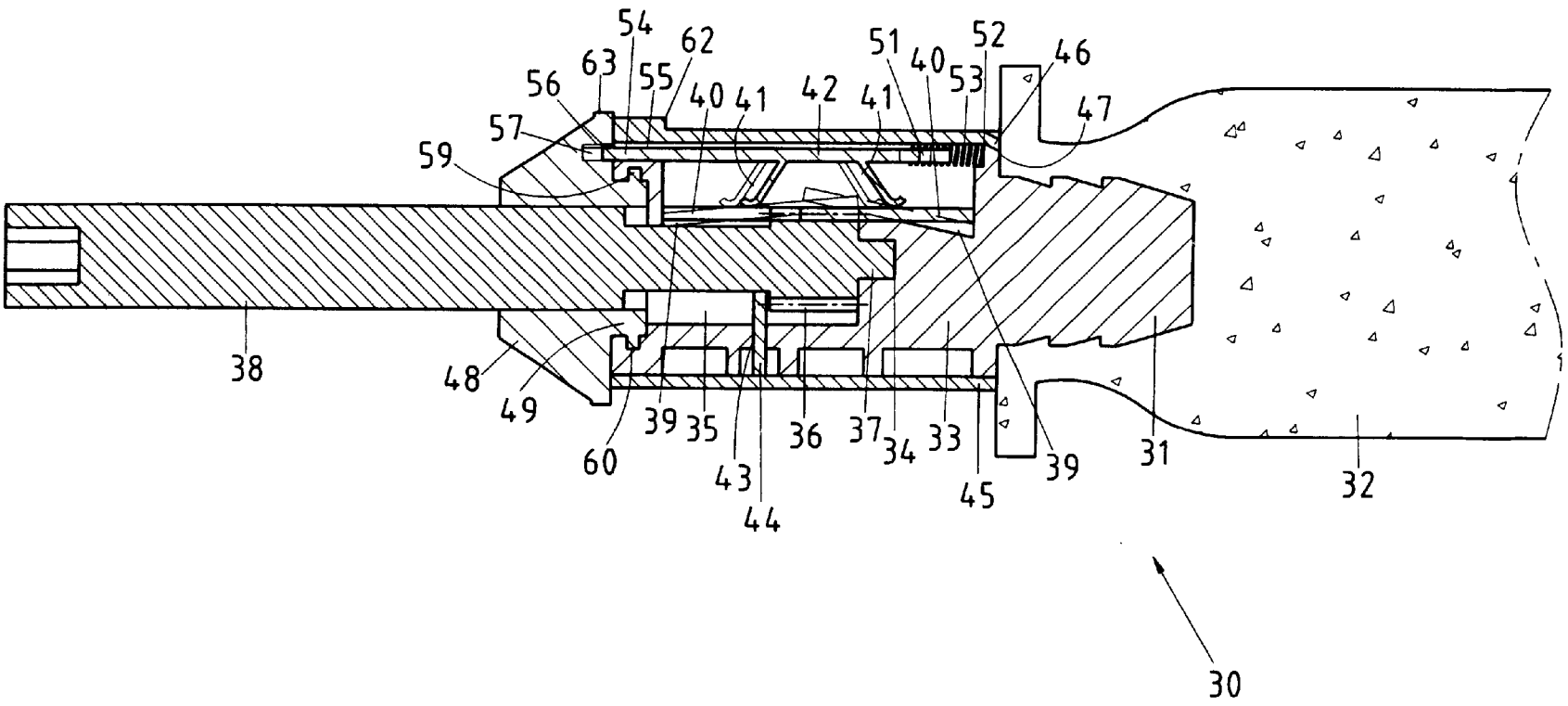
FIG. 6 shows a schematic view of the ratchet screwdriver of the present invention in action.
Figure 7:
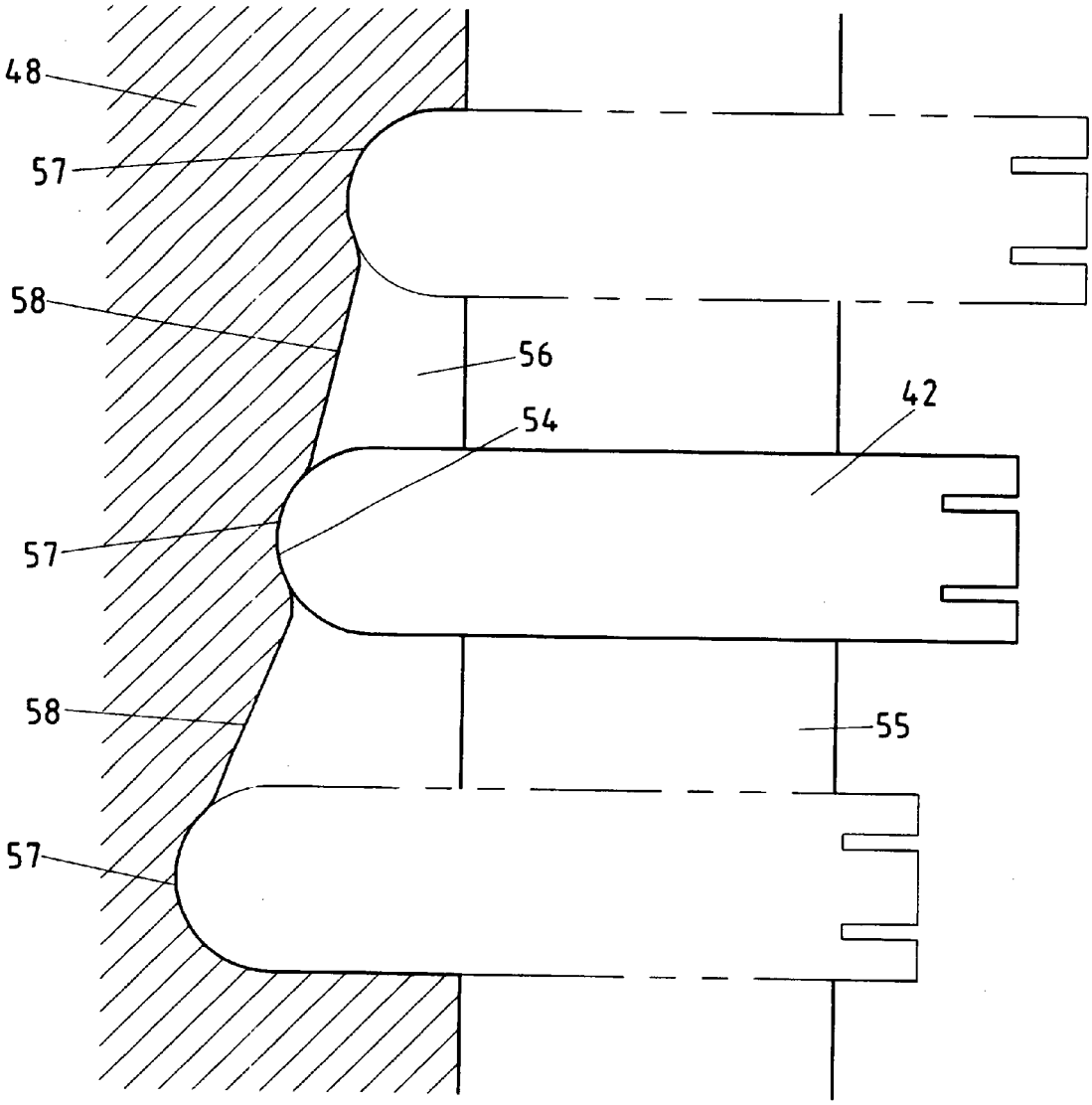
FIG. 7 shows another schematic view of the ratchet screwdriver of the present invention in action.

As shown in FIGS. 3–7, a ratchet screwdriver of the present invention comprises a handle 32 having a main body

33 which is provided with a fastening seat 31. The main body 33 is provided at the front end with an axial hole 35 having, a heart hole 34. The main body 33 is provided in the top with two locating slots 39 in communication with the axial hole 35. The main body 33 is fastened pivotally at the front end thereof to a shaft rod 38 having a gear 36 and a pillar 37. Two opposite reversing plates 40 are disposed in the locating slots 39 such that the two reversing plates 40 are engaged with the gear 36. The reversing plates 40 are provided with a dial seat 42 having two resilient press plates 41. The main body 33 is provided in the underside thereof with an insertion slot 43 for receiving a stop plate 44. The main body 33 is fitted into a housing 45 such that a rotation plate 46 of the housing 45 is retained in a recess 47 of the rear edge of the main body 33. The main body 33 is provided at the front end with a circular rotation member 48. The present invention is characterized by the dial seat 42 which is concealed completely by the housing 45. The dial seat 42 is provided with a bar body 51. Located between the bar body 51 and the position confining hole 52 is a tension element 53. The dial seat 42 is provided at the front end with an urging portion 54 which is juts out of the circular rotation member 48 via a slide slot 55 of the main body 33. The circular rotation member 48 is provided with a rotation slot 56 corresponding to the urging portion 54 of the front end of the dial seat 42. The rotation slot 56 is provided in the bottom wall with a plurality of locating portions 57 and guide slide portions 58. The circular rotation member 48 is provided on a neck portion 49 with an insertion protrusion 59 by means of which the circular rotation member 48 is pivoted in an insertion circular edge 60 of the main body 33. The insertion circular edge 60 is provided with a notch 61 for locating the insertion protrusion 59 for controlling the forward and the reverse motions of the ratchet screwdriver 30.

The housing 45 is provided in an appropriate position thereof with a mark line 62 for aligning with a mark line 63 of the locating portions 57 of the rotation slot of the circular rotation member 48.

Figure 8:
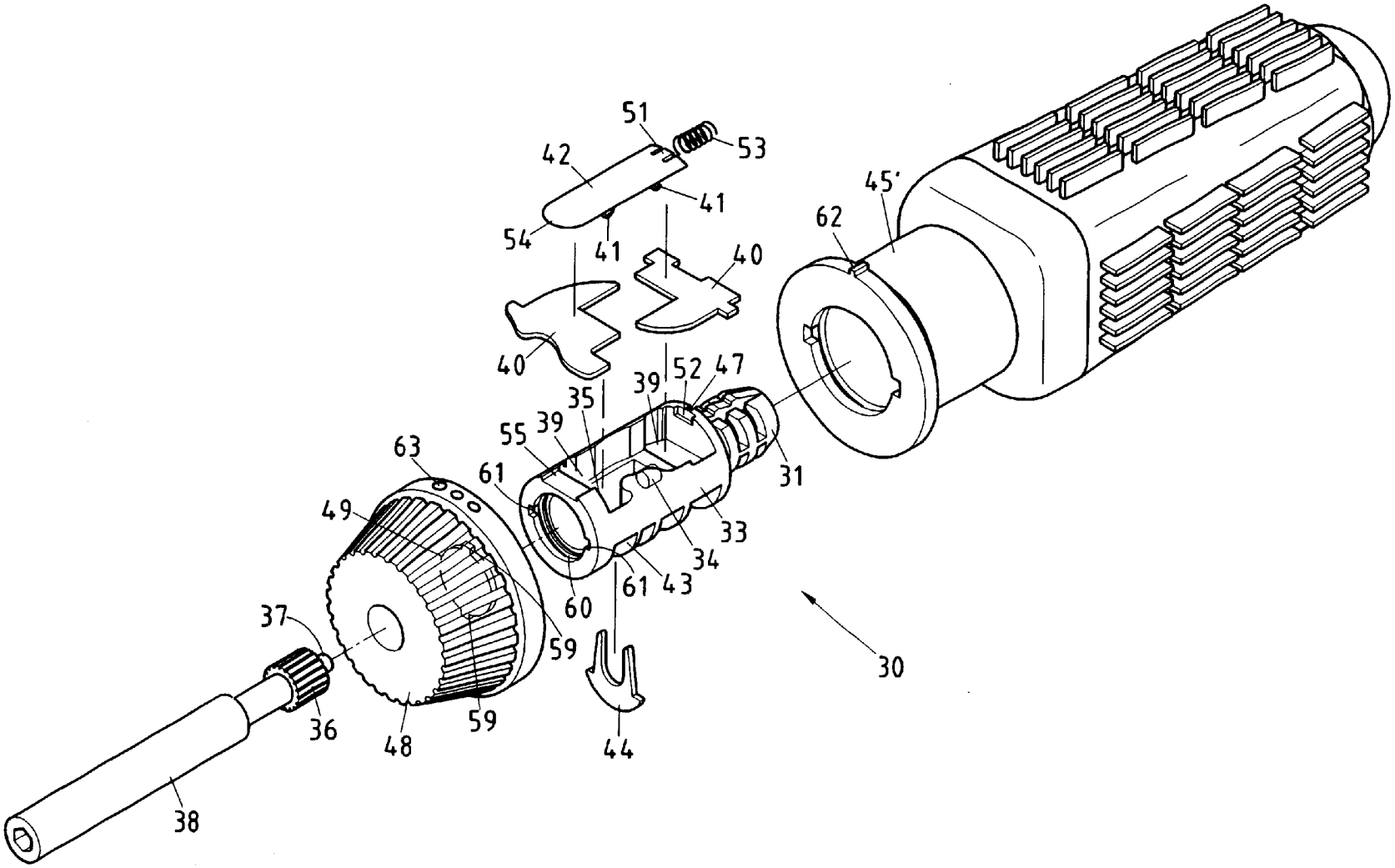
FIG. 8 shows an exploded view of another preferred embodiment of the present invention.
Figure 9:
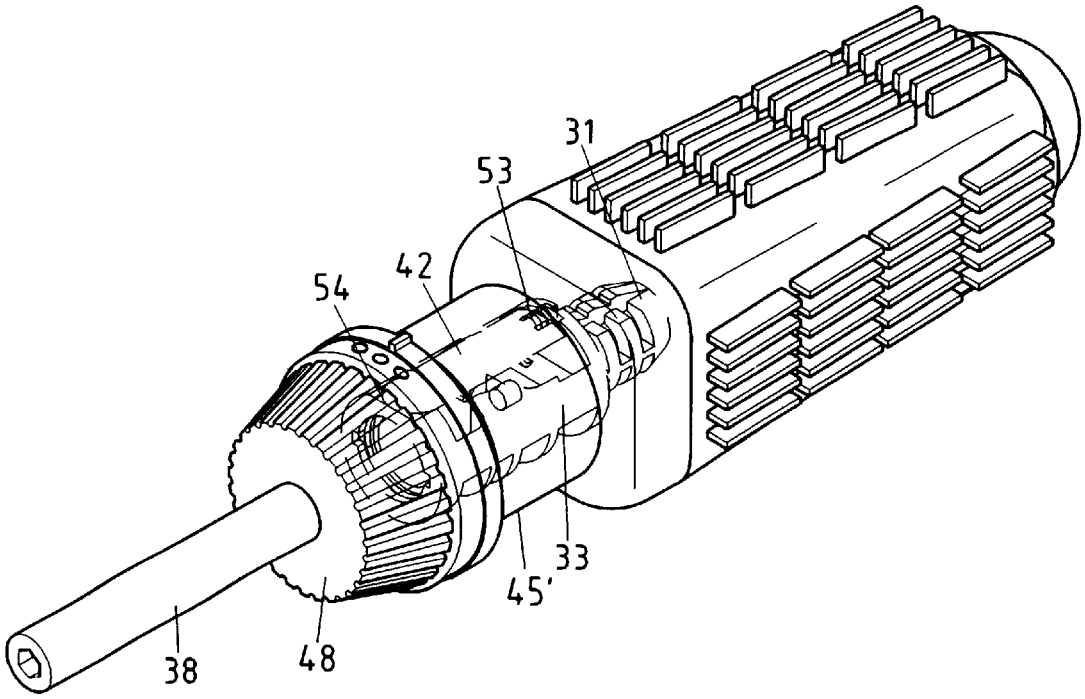
FIG. 9 shows a perspective view of another preferred embodiment of the present invention.
Figure 10:
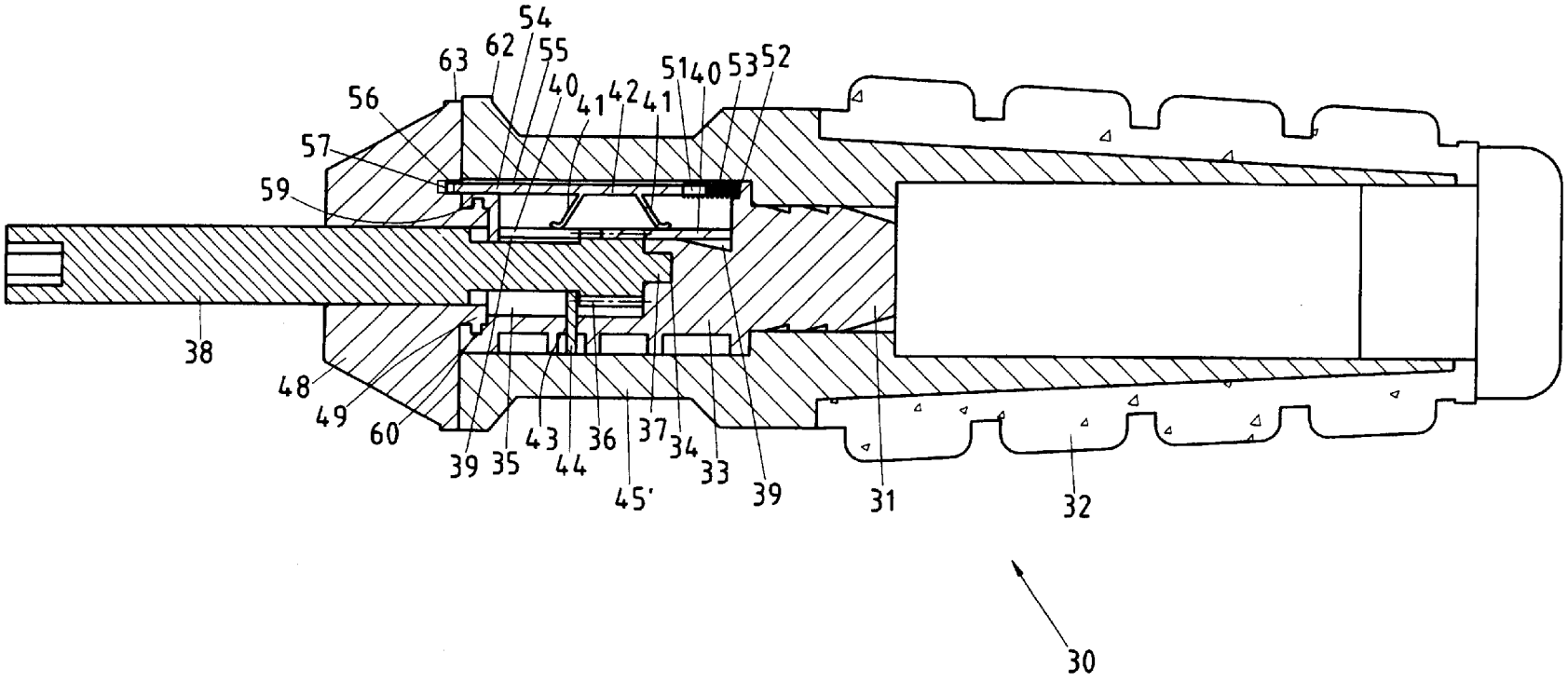
FIG. 10 shows a sectional view of another preferred embodiment of the present invention.

As shown in FIGS. 8–10, the fastening seat 31 of the main body 33 is fastened to the handle 32 of the ratchet screwdriver 30 such that the main body 33 is directly fitted into the housing 45', which is made integrally with the front end of the handle 32.

I claim:

1. A ratchet screwdriver comprising a handle having a main body which is provided with a fastening seat, said main body provided at a front end thereof with an axial hole having a heart hole, said main body further provided in a top thereof with two locating slots in communication with said axial hole, said main body being fastened pivotally at the front end thereof to a shaft rod having a gear and a pillar, said main body further provided with two reversing plates which are disposed in said two locating slots such that said two reversing plates are engaged with said gear, said reversing plates provided with a dial seat having two resilient press plates, said main body provided in an underside with an insertion slot for receiving a stop plate, said main body being fitted into a housing such that a rotation stopping plate of said housing is retained in a recess of a rear edge of said main body, said main body provided at the front end with a circular rotation member; wherein said dial seat is completely concealed by said housing and is provided with a bar body, a position confining hole, and a tension element, said dial seat further provided at the front end with an urging portion which is juts out of said circular rotation member via said slide slot of said main body, said circular rotation member provided with a rotation slot corresponding to said urging portion of the front end of said dial seat, said rotation slot provided in a bottom with a plurality of locating portions and guide slide portions, said circular rotation member provided on a neck portion with an insertion protrusion by means of said insertion protrusion said circular rotation member is pivoted in an insertion circular edge of said main body, said insertion circular edge provided with a notch for locating said insertion protrusion.

2. The ratchet screwdriver as defined in claim 1, wherein said housing is provided in an appropriate position thereof with a mark line; wherein said locating portions of said rotation slot of said circular rotation member are provided with a mark line which is aligned with said mark line of said housing.

3. The ratchet screwdriver as defined in claim 1, wherein said housing is integrally made with said handle; wherein said fastening seat of said main body is fastened to said handle such that said main body is fitted into said housing.

* * * * *